US008230849B2

(12) United States Patent
Jacklich et al.

(10) Patent No.: US 8,230,849 B2
(45) **Date of Patent: *Jul. 31, 2012**

(54) WALL THIMBLE WITH OUTSIDE AIR INLET

(75) Inventors: John R. Jacklich, Napa, CA (US); Eric Adair, Dixon, CA (US)

(73) Assignee: M&G DuraVent, Inc., Vacaville, CA (US)

( * ) Notice: Subject to any disclaimer, the term of this patent is extended or adjusted under 35 U.S.C. 154(b) by 525 days.

This patent is subject to a terminal disclaimer.

(21) Appl. No.: 12/544,996

(22) Filed: Aug. 20, 2009

(65) Prior Publication Data

US 2010/0037883 A1 Feb. 18, 2010

Related U.S. Application Data

(63) Continuation-in-part of application No. 11/743,065, filed on May 1, 2007, now Pat. No. 7,665,457.

(51) Int. Cl.
*F23L 17/04* (2006.01)
*F24C 3/00* (2006.01)

(52) U.S. Cl. ..... 126/80; 126/84; 126/94; 126/21 R; 126/15 R; 454/231

(58) Field of Classification Search ..... 126/80, 126/94, 21 R, 15 R, 314, 316; 454/231
See application file for complete search history.

(56) References Cited

U.S. PATENT DOCUMENTS

| | | | | |
|---|---|---|---|---|
| 2,755,794 | A | 7/1956 | Wendell | |
| 3,688,681 | A | 9/1972 | Iversen et al. | |
| 5,282,456 | A | 2/1994 | Smelcer et al. | |
| 5,311,930 | A * | 5/1994 | Bruenn | 165/102 |
| 5,399,119 | A | 3/1995 | Birk et al. | |
| 5,562,088 | A | 10/1996 | Valters et al. | |
| 5,715,808 | A | 2/1998 | Wilhoite | |
| 6,039,041 | A | 3/2000 | Barth | |
| 6,053,162 | A | 4/2000 | Godfree et al. | |
| 6,109,339 | A | 8/2000 | Talbert et al. | |
| 6,647,977 | B2 | 11/2003 | Lesage | |
| 6,848,720 | B2 * | 2/2005 | Carns et al. | 285/123.15 |
| 2007/0221195 | A1 | 9/2007 | Bibaud et al. | |

OTHER PUBLICATIONS

Office Action dated Feb. 1, 2012, U.S. Appl. No. 12/605,985.

* cited by examiner

*Primary Examiner* — Steven B McAllister
*Assistant Examiner* — Nikhil Mashruwala
(74) *Attorney, Agent, or Firm* — Vierra Magen Marcus & DeNiro LLP

(57) ABSTRACT

An improved wall thimble as part of a venting apparatus for a heating appliance. Dual functionality is provided in a single wall thimble device by having a vent path for exhausting combustion by-products, and a separate air inlet path to draw in combustion air for use by the heating appliance. The wall thimble is preferably formed as a two-cylindrical part housing such that a first portion can be inserted into a second portion. When a smaller exhaust pipe is routed through the two-part housing, an annular region is formed between the exhaust pipe and the walls of the housing. A first air vent is formed in the first portion to draw combustion air into the annular region from outside. A second air vent is formed in the second portion to route the combustion air from the annular region out through the second air vent to be coupled with the combustion air inlet. A baffle is disposed in the first portion to preheat the combustion air. A duct assembly with an adjustable extension may be coupled to the second air vent to provide a below-grade installation.

20 Claims, 10 Drawing Sheets

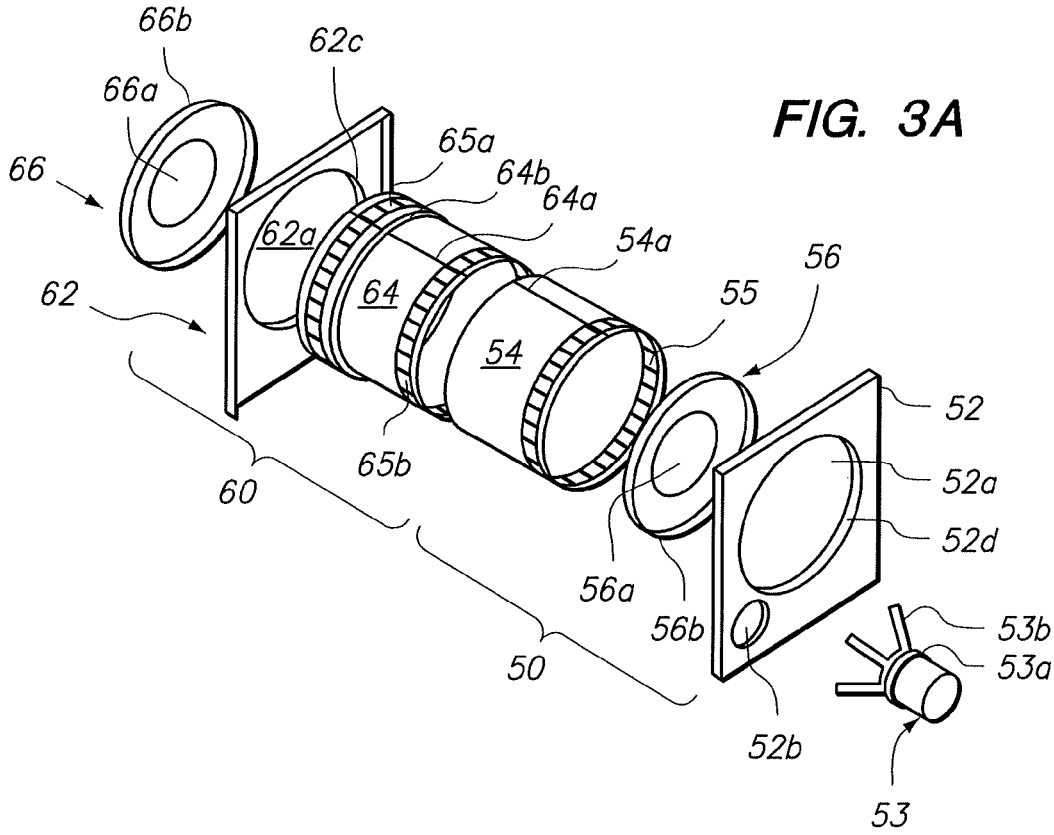
FIG. 3A
FIG. 3B
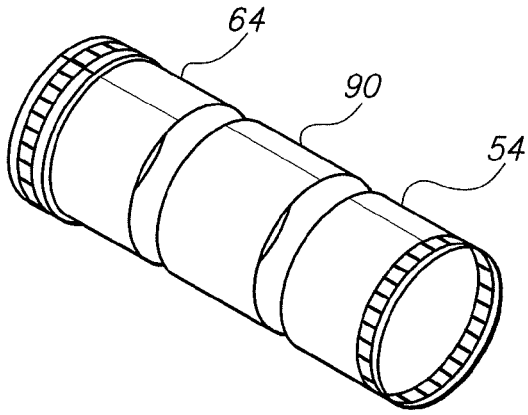

WALL THIMBLE WITH OUTSIDE AIR INLET

CROSS-REFERENCE

This application is a continuation-in-part of application Ser. No. 11/743,065.

TECHNICAL FIELD

The present disclosure is directed to a wall interface device commonly known as a "wall thimble," which is useful to provide a routing path to run piping for venting combustion by-products from a heating appliance and for providing combustion air to the heating appliance.

BACKGROUND

Fuel-burning appliances, including wood stoves and pellet stoves, require an exhaust system in order to vent combustion by-products, such as noxious gases, fine ash, and water vapor, to the outside of the structure containing the appliance. In addition, combustion air must be supplied to the appliance to properly fuel the fire. In a typical installation, the appliance includes a mechanical fan to both blow the combustion by-products out through the exhaust pipe and to draw combustion air in through a separate air inlet pipe. However, it is also typical to create two different openings in the wall adjacent to the heating appliance, one for routing the exhaust outlet, and one for routing the combustion air inlet.

It would be desirable to have a single component that provides two paths—one for the exhaust outflow, and one for the combustion air inflow, such that only a single opening in the exterior wall is required.

BRIEF DESCRIPTION OF THE DRAWINGS

FIG. 3A is an exploded perspective view of the wall thimble shown in FIGS. 1 and 2.

FIG. 3B is an alternative embodiment of a portion of the wall thimble shown in FIG. 3A.

DETAILED DESCRIPTION

The present disclosure is directed to a wall interface device for a heating appliance, commonly referred to as a "thimble" or "wall thimble" and a method of using the same. Advantageously, the thimbles described herein provide dual functionality in a single device by having a vent path for exhausting combustion by-products, and a separate air inlet path to draw in outside combustion air for use by the heating appliance. It should be recognized that the description is not intended to be limiting with respect to the features or application of the dual function thimble, which are readily applicable to all types of heating appliances.

Figure 1:
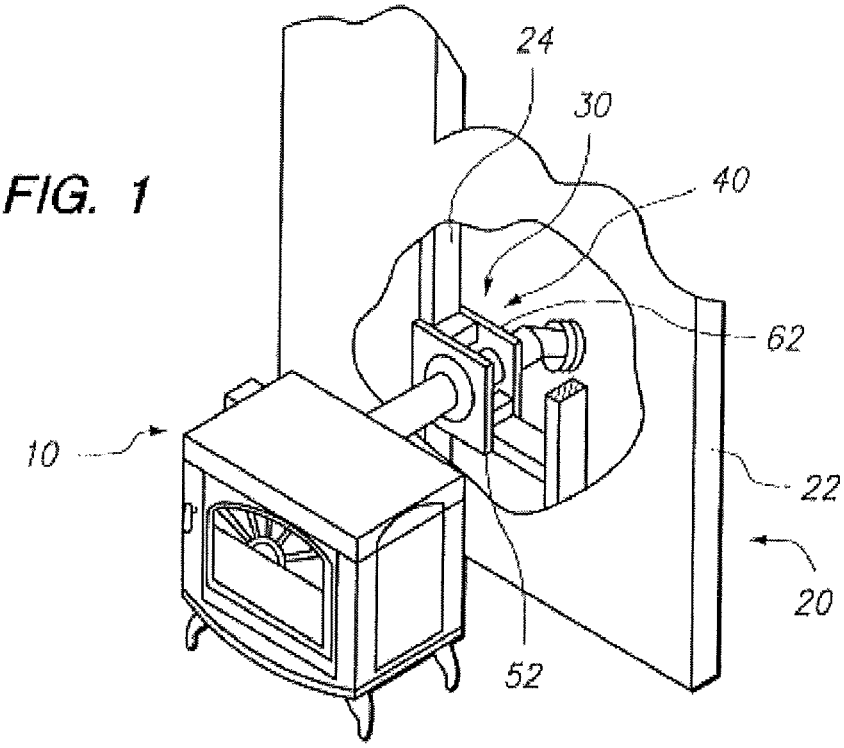
FIG. 1 is a perspective view of one embodiment of a typical pellet stove installation including an exhaust/intake system.
Figure 2:
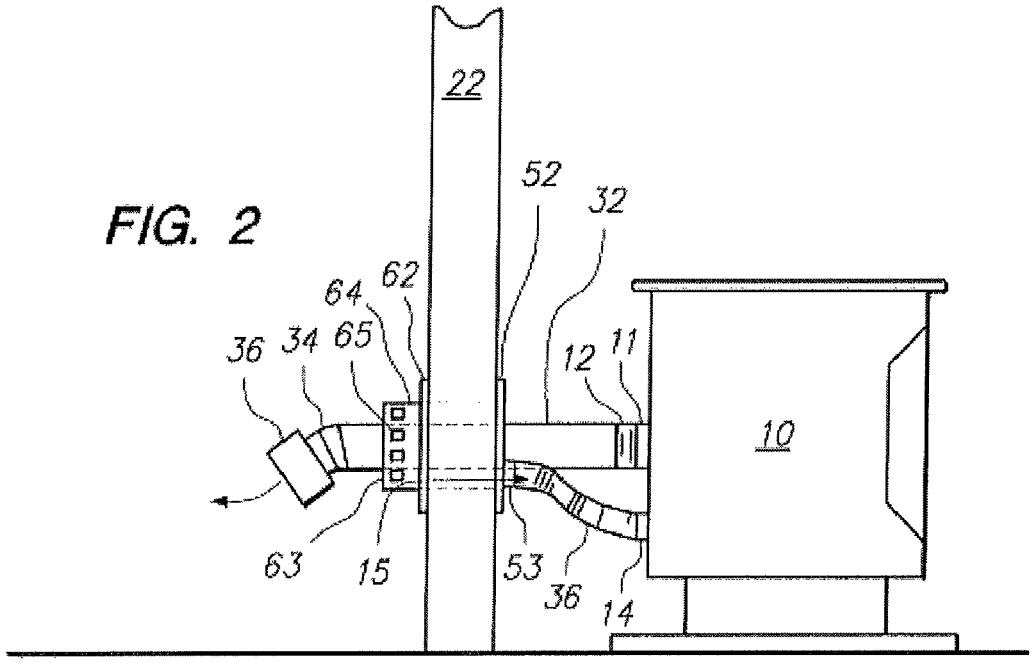
FIG. 2 is a side plan view through section 2-2 of FIG. 1.

Referring now to FIGS. 1-2, one embodiment of a stove 10 and a corresponding exhaust/intake system 30 is illustrated. The stove 10 may be a pellet stove or any other heating appliance, including a gas-fired stove, wood-burning stove, or corn-burning stove. The stove 10 is installed on the inside of structure 20 near an exterior wall 22. Typical clearance is three inches minimum from the wall, although applicable building codes and industry practices should be followed.

The illustrated exhaust/intake system 30 provides horizontal venting through an opening in exterior wall 22, although alternative venting techniques could be used and will be readily apparent to workers in this field. The exhaust/intake system 30 may be fabricated using standard sheet metal materials with conventional bending and fastening techniques.

The exhaust/intake system 30 includes a vent pipe 32 which is coupled to the exhaust outlet 11 of stove 10 (shown in FIG. 2), and which extends through a thimble 40, which is mounted in wall 22, to the exterior of structure 20. Proper venting is critical to combustion performance, and local building codes and manufacturers' installation instructions typically require that a vent pipe for heating appliances be specifically tested and listed by Underwriters Laboratories ("UL") or other ANSI recognized test facility for use with the appliance. For example, type PL vent pipe, tested to UL 641, is listed for use with pellet stoves, and is commonly available in 3 inch and 4 inch diameter pipe. Type PL vent pipe is a double-walled cylindrical pipe, wherein the stainless steel inner pipe carries the exhaust products and is separated from the outer wall by an air space. For stoves that require PL vent pipe, substitute venting materials should not be used unless such materials are approved by the manufacturer and/or local building codes.

In one embodiment of pipe 32, the inner flue is formed using 0.012 inch type 430 stainless steel, and the outer wall is formed using 0.018 inch galvalume steel to provide heat and corrosion resistance. A one-quarter inch annular air space is provided between the inner and outer walls to provide for static air insulation and to ensure safe outer wall temperatures, while also providing a minimum clearance to nearby combustibles. To prevent fly ash leakage, each pipe joint is sealed, for example, with a silicone O-ring gasket. In addition, all elbows, tees, and fittings are sealed with a liberal amount of room-temperature-vulcanizing ("RTV") silicone.

The thimble 40 provides an inside/outside interface and is mounted in an opening specially formed in the exterior wall 22 to accommodate the exhaust/intake system 30. The thimble 40 includes an inside plate 52 that is mounted to the wall 22 on the inside of structure 20, and an outside plate 62 that is mounted to the wall 22 on the outside of structure 20.

For example, the inside plate 52 and outside plate 62 may be rigidly affixed to structural members 24 of wall 22.

The side view shown in FIG. 2 shows more clearly the inside/outside transition of the exhaust/intake system 30 through wall 22. The stove 10 has an exhaust outlet 11 and includes an adaptor 12, which may be separate from the stove 10 in some embodiments, coupled to the exhaust outlet. A section of exhaust pipe 32 is coupled to the stove 10 via the adaptor 12. The inside plate 52 and the outside plate 62 are mounted to the wall 22, as noted above, to rigidly fix the thimble 40 in place. The exhaust pipe 32 is routed through the thimble 40 into an elbow 34, and terminated into a round horizontal cap 36. Typically, the terminus of the exhaust pipe 32 should extend at least 12 inches from the exterior wall 22.

Figure 4:
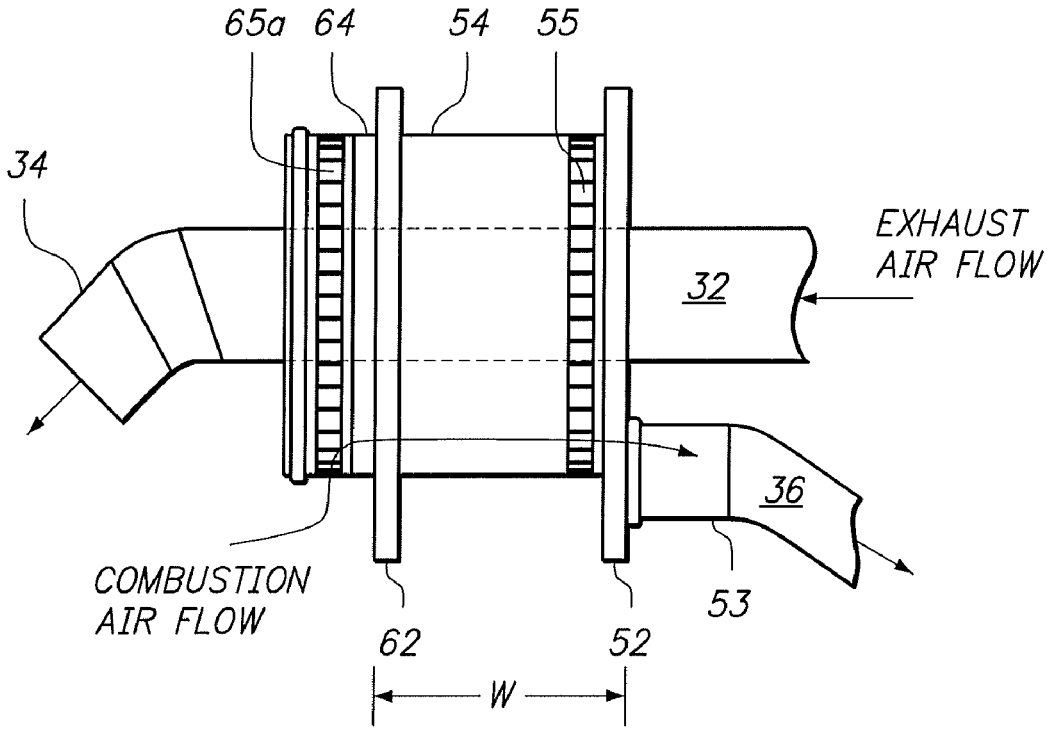
FIG. 4 is a magnified side plan view of a portion of FIG. 3A.

As better shown in FIGS. 3-4, the thimble 40 includes an inner band 64 that is rigidly affixed to the outside plate 62, and sized to fit snugly inside of outer band 54, as described more fully below. The inner band 64 includes a distal portion 63 that extends from the outside plate 62 and wall 22 approximately two inches. A plurality of vent openings 65 are formed on the distal portion 63 of inner band 64. A short inlet pipe 53 is coupled to an opening 52*b* (shown in FIG. 3A) on the inside plate 52, and an inlet air tube 36 is coupled to the inlet pipe and to the combustion air inlet 14 of stove 10. Thus, advantageously, the thimble construction allows outside air to be drawn in through vent openings 65 and directed through the inlet air tube 36 to the combustion air inlet 14 of stove 10, as shown by arrow 15. The thimble 40 includes a housing having two main portions that mate with each other, namely an inside housing portion 50 and an outside housing portion 60, and that are each formed as a separate, integral assembly. Advantageously, when the thimble 40 is mounted into a suitable opening in wall 22, the outside housing portion 60 fits within inside housing portion 50. More specifically, the inner band 64 is sized to fit within outer band 54. Further, the length of housing portions 50 and 60 is sufficient to allow the total thickness W of the thimble to be adjusted during field installation to accommodate for differences in wall thicknesses. For example, in one construction, the housing portions allow the thimble thickness W to be adjustable between approximately 5.75 to 8.00 inches. In another construction, shown in FIG. 3B, an extension piece go can be provided and coupled in the field between housing portions 54 and 64. All pipe couplings are sealed and gasketed in the field upon installation.

The inside housing portion 50 includes inside plate 52, inlet pipe 53, outer band 54, and inlet cap 56. In one embodiment, the inside plate 52 measures approximately 11 inches wide by 11 inches tall, and includes a first opening 52*a* and a second opening 52*b*. The first opening 52*a* is centrally located at approximately 5 inches from the top and 4.5 inches from the sides of plate 52, and measures approximately 6.964 inches in diameter. The second opening 52*b* is located in one corner of the plate 52, and is centered at approximately 1.985 inches from the bottom of plate and 2.165 inches from the side of the plate, and measures approximately 2.000 inches in diameter. The outside edges 52*c* of the plate 52 are folded back at a right angle approximately one-half inch or less on all four sides, and a circular flange 52*d* of similar dimension is formed inside of opening 52*a*. The inside plate 52 is formed from 0.018 inch galvanized steel plate or other suitable material.

The inlet pipe 53 is formed from 0.018 inch type 304 stainless steel, which provides excellent corrosion resistance, or other suitable material. The length of inlet pipe 53 is approximately 2 inches, and it is cold-rolled into a cylinder measuring approximately 2.000 inches in effective diameter (adequate to fit within opening 52*b*), then riveted and spot welded to maintain the cylinder shape. A roll bead 53*a* is formed near one end of the inlet pipe 53, and that end of the inlet pipe after the roll bead is cut into tabs 53*b*. The inlet pipe 53 is inserted into opening 52*b* until stopped by the roll bead 53*b*. At least some of the tabs 53*b* are then folded over and spot welded to the inside of inside plate 52, for example, with four resistance welds are that applied at go degrees spacing.

The outer band 54 is 0.018 inch zinc-plated galvanized steel plate or other suitable material, and is cold-rolled into a generally cylindrical, hollow section then riveted or welded at the seam 54*a* to maintain the shape. The outer band 54 has an outside diameter of approximately 7.000 inches and a length of approximately 5 inches. A plurality of vent openings 55 are formed approximately three-quarters inch from the end of outer band 54 proximate to inside plate 52. The vent openings 55 are approximately one-half inch square, and cover the entire circumference around band 54, but in some embodiments could cover only a portion of the circumference, for example one-quarter or one-half. Further, the number and size of the vent openings can be changed as desired or based on empirical studies of combustion air flow.

The inlet cap 56 is 0.018 inch zinc-plated galvanized steel plate or other suitable material, and is formed into a circular piece measuring approximately 6.964 inches in diameter, and having an opening 56*a* measuring approximately 3.750 inches in diameter, and a right angle flange 56*b* of approximately one-half inch depth.

The inside housing portion 50 is assembled together by coupling the inlet cap 56 and outer band 54 to the inside plate 52. This is done by fitting the flange 56*b* of inlet cap 56 over the flange 52*d* of inside plate 52, then fitting the end of outer band 54 over both sets of flanges, then pop riveting these components together, for example, with four rivets spaced at go degrees.

The outside housing portion 60 includes outside plate 62, inner band 64, and outlet cap 66. The outside plate 62 measures approximately 11 inches wide by 11 inches tall, and includes an opening 62*a*. The opening 62*a* is centrally located at approximately 5 inches from the top and 4.5 inches from the sides of outside plate 62, and measures approximately 7.000 inches in diameter. The outside edges 62*b* of outside plate 62 are folded back at a right angle approximately one-half inch or less on all four sides, and a circular flange 62*c* of similar dimension is formed to the outside of opening 62*a*. The outside plate 62 is formed from 0.018 inch galvanized steel plate or other suitable material.

The inner band 64 is 0.018 inch zinc-plated galvanized steel plate or other suitable material, and is cold-rolled into a generally cylindrical, hollow section then riveted or welded at the seam 64*a* to maintain the shape. The inner band 64 has an outside diameter of approximately 6.964 inches and a length of approximately 5 inches. A plurality of vent openings 65*a* are formed near one end of inner band 64. The vent openings 65*a* are each approximately one-half inch square, and cover the entire circumference around inner band 64, but in some embodiments could cover only a portion of the circumference. Also, the number and size of the vent openings could be adjusted. A roll bead 64*b* is formed on inner band 64 approximately 1½inches from the end nearest outside plate 62.

The outlet cap 66 is 0.018 inch zinc-plated galvanized steel plate or other suitable material, and is formed into a circular piece measuring approximately 6.964 inches in diameter, and having an opening 66*a* measuring approximately 3.750 inches in diameter, and a right angle flange 66*b*.

The outside housing portion 60 is assembled together by coupling the outlet cap 66 and inner band 64 to the outside plate 62. The inner band 64 is fit through opening 62*a* in outside plate 62 until stopped by roll bead 64*b*, at which point the end of the inner band extends beyond the outside plate 62 by approximately 1½ inches such that openings 65*a* are exposed outside of exterior wall 22. The flange 62*c* of outside plate 62 is attached to the inner band 64 using 6 resistance welds spaced at 60 degrees. The flange 66*b* of outlet cap 66 is fit over the end of inner band 64, and corresponding roll beads (not shown) are formed, then resistance welds are applied, for example, at go degrees spacing.

The inside housing portion 50 and outside housing portion 60 are pre-assembled, then are fitted together during field installation and securely attached to wall 22. The slight difference in diameters of the outer band 54 and the inner band 64 allows the inner band to be inserted into the outer band, as previously noted. Thus, as shown in FIG. 4, the outer band 54 including vent openings 55 overlies the inner band 64 between the inside plate 52 and the outside plate 62. However, because inner band 64 extends beyond the plane of outside plate 62 to the outside, vent openings 65*a* of inner band 64 are exposed. Thus, variations in wall thicknesses can be accommodated by changing how far the inner band 64 is inserted into the outer band 54. In addition, the outer band 54 and inner band 64 may be rotated relative to each other during installation as desired to achieve an optimum placement of the thimble components.

Finally, exhaust pipe 32 is fitted through the openings 56*a* and 66*a* in inlet cap 56 and outlet cap 66, respectively, and coupled to exhaust outlet 11 on the stove and to terminus elbow 34 outside the exterior wall. Thus, the exhaust pipe 32 provides an inside passageway in thimble 40 for carrying exhaust by-products to the exterior of the structure, while at the same time creating an annulus or outside passageway between the pipe and the bands 54, 64 for carrying combustion air from the outside to the appliance combustion air inlet 14.

Figure 5A:
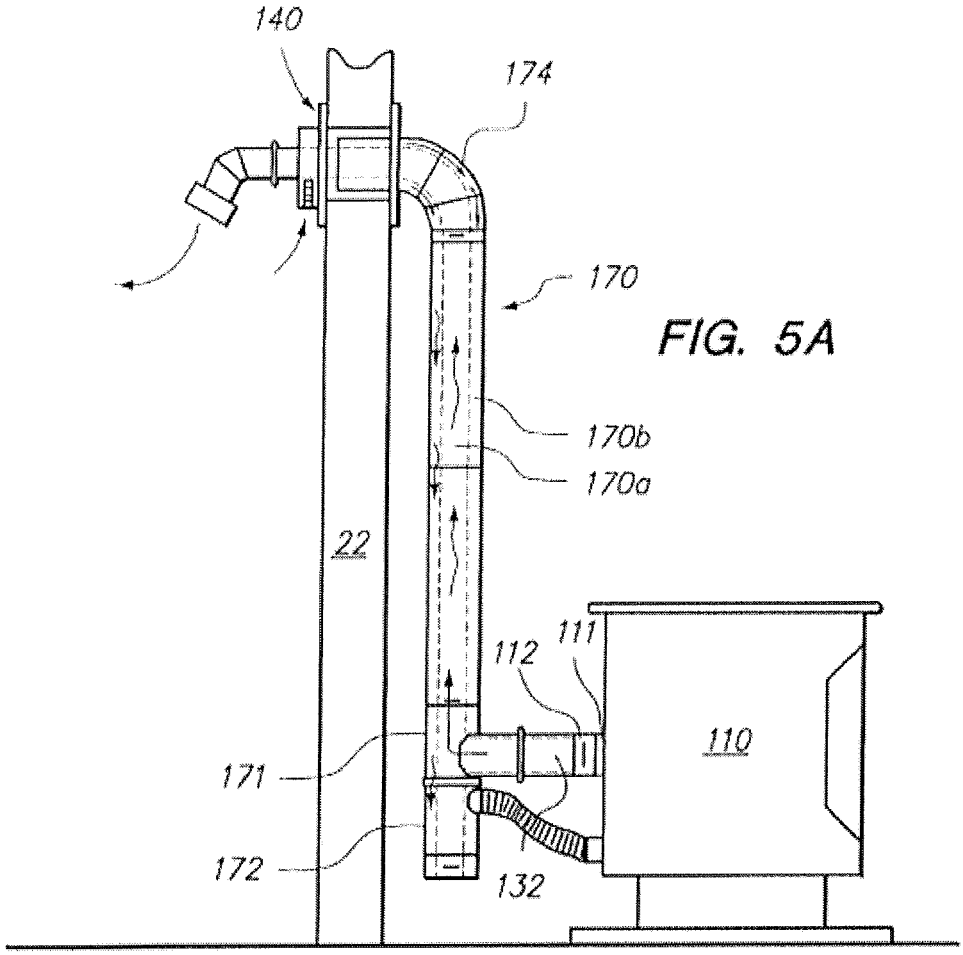
FIG. 5A is a side plan view of a second embodiment of a typical pellet stove installation including an exhaust/intake system.
Figure 5B:
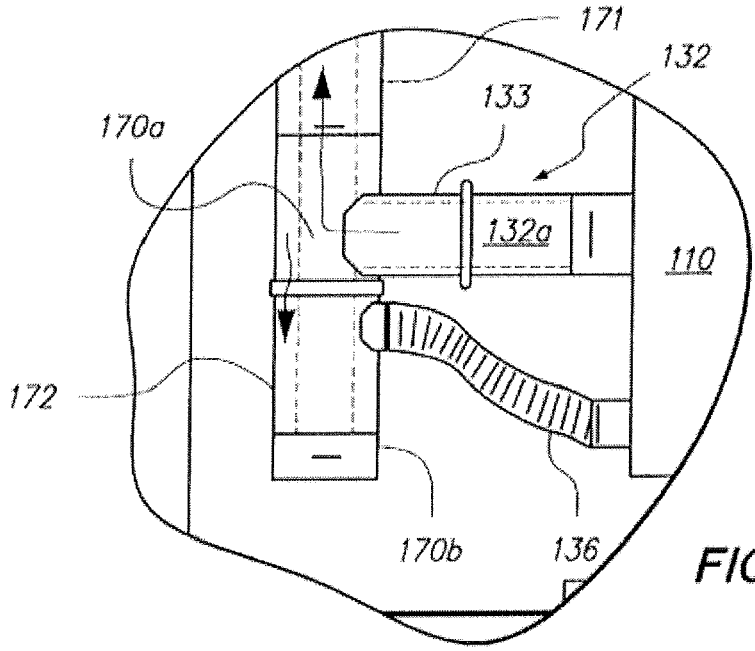
FIG. 5B is a magnified side plan view of a portion of FIG. 5A.

Another embodiment is shown in FIGS. 5A and 5B, wherein thimble 140 is mounted higher in side wall 22, thus requiring a section 170 of vertical pipe to couple the exhaust pipe 132 to the thimble. Materials and dimensions are consistent with those described above, but could be varied depending on the application. The vertical pipe section 170 is a larger diameter double-walled pipe than exhaust pipe 132. For example, in one typical embodiment, exhaust outlet ill of stove 110 is a standard 3 inch diameter flue. A standard appliance adapter 112 (if necessary) couples exhaust pipe 132 to the flue 111. Exhaust pipe 132 is a double-walled type PL pipe, wherein the inner pipe has a diameter of 3 inches and the outer wall has a diameter of 3.75 inches.

The vertical pipe section 170 is also a double-walled pipe, such as a standard stovepipe, having an outer wall diameter of approximately 6.625 inches and an inner pipe diameter of approximately 4 inches, although other sizes could be provided, such as 7 inches OD by 4 inches ID; 8 inches OD by 5 inches ID; and 8.625 inches OD by 5 inches ID. Referring to FIG. 5B, a standard single tee section 171 couples section 133 of exhaust pipe 132 to the vertical pipe 170. Note that the inner pipe 132*a* of exhaust pipe 132 is coupled to the inner pipe 170*a* of pipe 170. Another single tee section 172 couples a flexible air inlet hose 136 to the annular region 170*b* between the inner pipe and outer wall of pipe 170. An elbow 174 is coupled to the top of the vertical pipe 170 and to the wall thimble 140.

Figure 6:
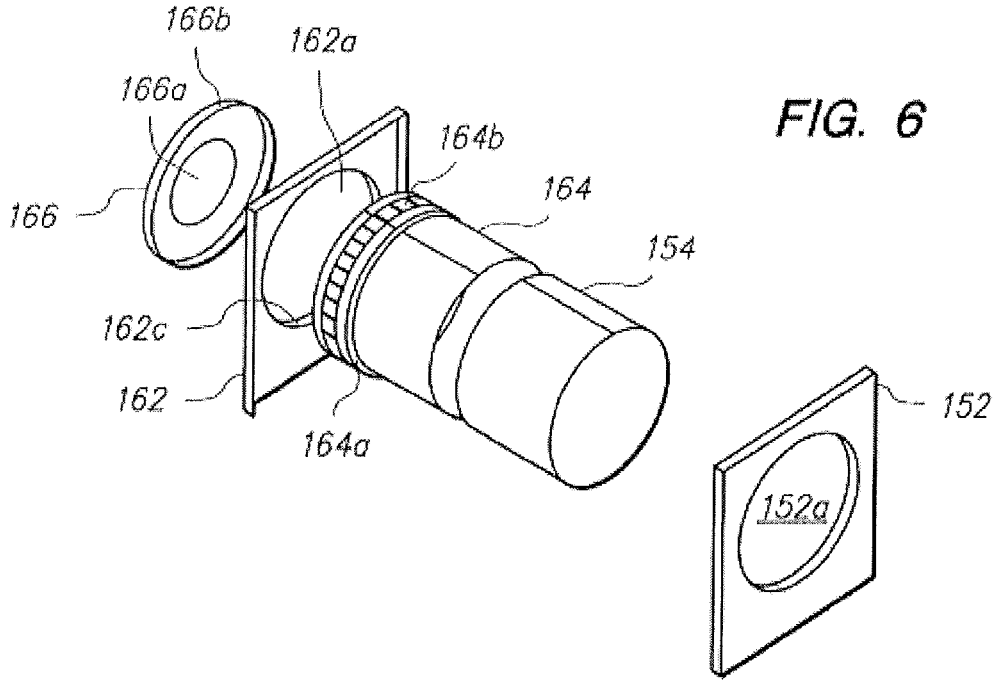
FIG. 6 is an exploded perspective view of the wall thimble shown in FIG. 5A.

As shown in FIG. 6, the thimble 140 is a two-part structure, namely inside housing portion 150 and outside housing portion 160. The inside housing portion 150 includes inside plate 152 and outer band 154. The inside housing portion 150 is assembled together by coupling the outer band 154 to the inside plate 152. This is done by fitting the end of outer band 154 over flange 152*a* of inside plate 152, then pop riveting these components together, for example, with four rivets spaced at go degrees.

The outside housing portion 160 includes outside plate 162, inner band 164, and outlet cap 166. A roll bead 164*a* and vent openings 164*b* are provided on one end of the inner band 164. The outside housing portion 160 is assembled together by coupling the outlet cap 166 and inner band 164 to the outside plate 162. The inner band 164 is fit through opening 162*a* in outside plate 162 until stopped by roll bead 164*a*, at which point the end of the inner band extends beyond the outside plate 162 by approximately 1½ inches such that vent openings 164*b* are exposed on the outside of wall 22. The flange 162C of outside plate 162 is attached to the inner band 164 using 6 resistance welds spaced at 60 degrees. The flange 166*b* of outlet cap 166 is fit over the end of inner band 164, and corresponding roll beads (not shown) are formed, then resistance welds are applied, for example, at go degrees spacing.

Figure 7:
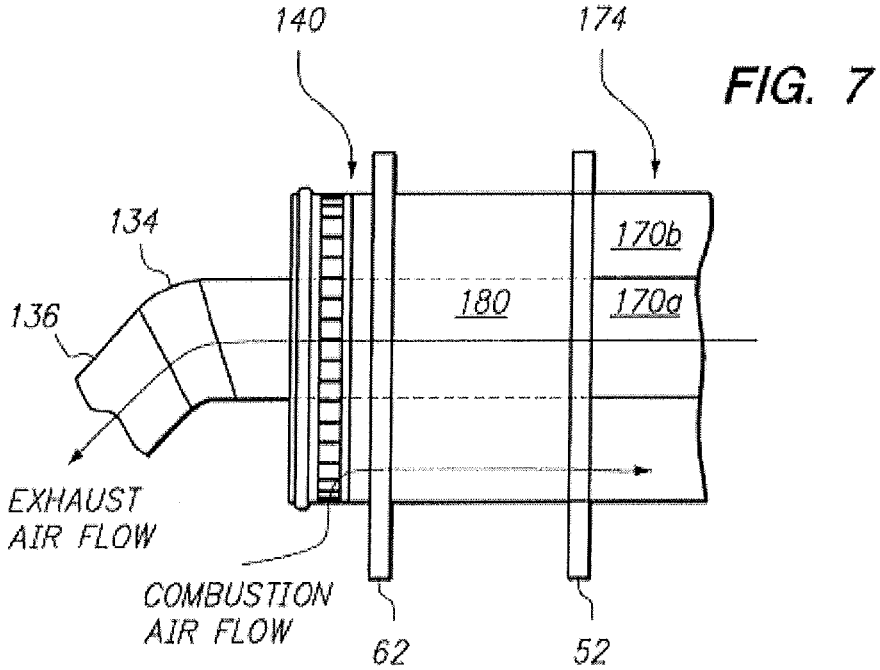
FIG. 7 is a magnified side plan view of a portion of FIG. 6.

The inside housing portion 150 and outside housing portion 160 are pre-assembled as described above, then installed in the field. For example, the elbow 174 is fitted into the opening 152*a* of inside plate 152 such that the outer wall of the elbow fits snugly within outer band 154. The joint is then sealed with a high temperature ceramic rope gasket and a liberal amount of RTV. As better shown in FIG. 7, a double-walled type PL pipe 180 is then routed through opening 166*a* of outlet cap 166 and coupled to the inner pipe 170*a*. The end of pipe 180 is coupled to elbow 134 and finally to horizontal cap 136. Thus, the double-walled vertical pipe 170 couples directly to the thimble and provides a first passageway 170*a* for venting exhaust by-products to the outside, and a second passageway 170*b* for drawing combustion air into the stove.

Referring to FIGS. 8A-8D, another embodiment of an exhaust/intake system 200 is illustrated schematically. This embodiment includes two additional features, namely, a thimble with internal baffles, and rigid extension sections for delivering combustion air to the heating appliance in a low grade or below grade installation. Materials and dimensions are consistent with the previously described embodiments, but could be varied based on the application.

Figure 8A:
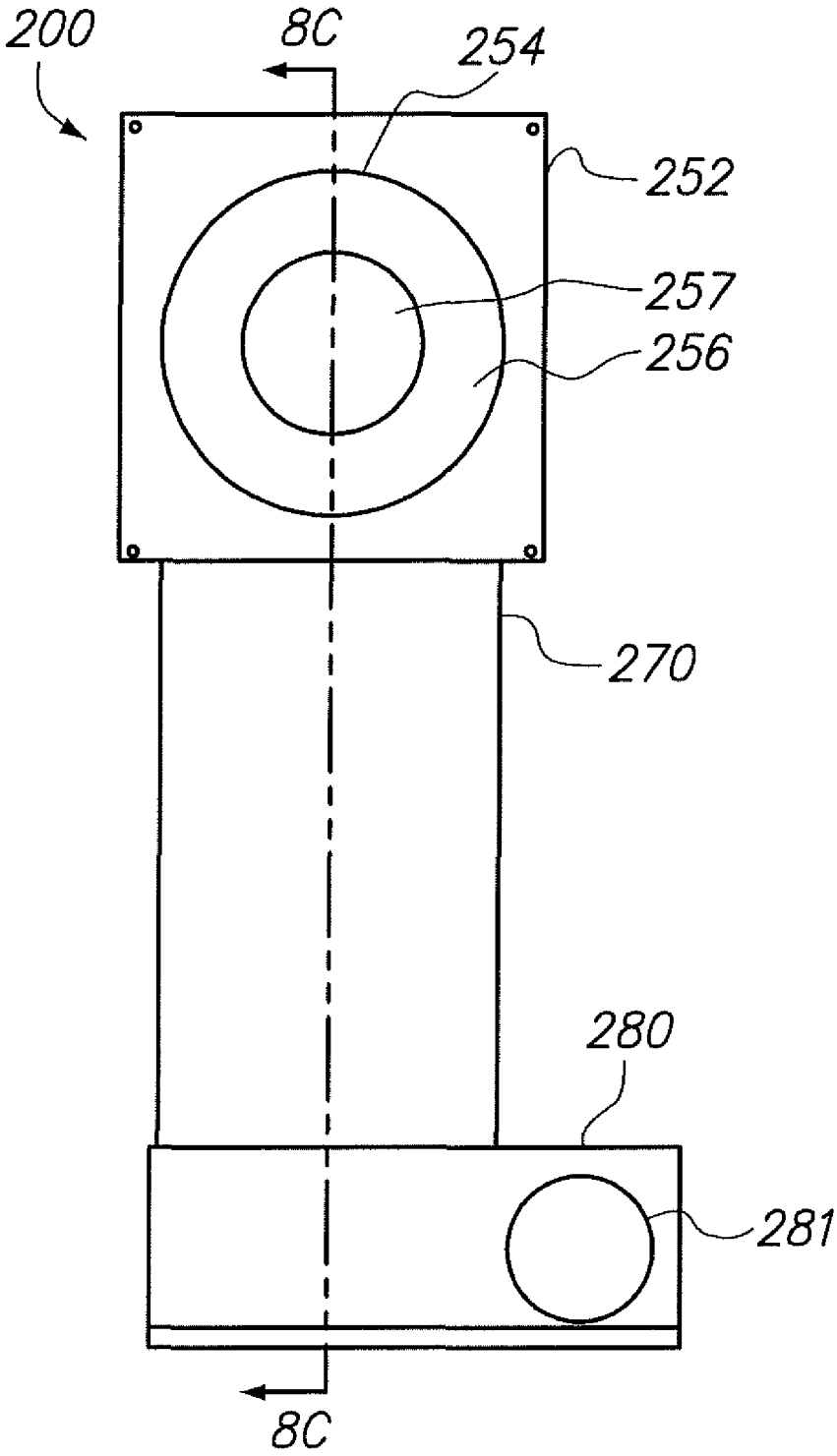
FIG. 8A is a front plan view of an alternative embodiment of an exhaust/intake system.

FIG. 8A shows a front plan view of system 200, i.e., as attached to a wall behind the heating appliance, including the interior cylinder section 254 of wall thimble 240 attached to the interior mounting plate 252, with vertical extension section 270 coupled to the interior mounting plate 252 and interior cylinder section 254, and exit section 280 coupled to the vertical extension section, as further described below.

Figure 8B:
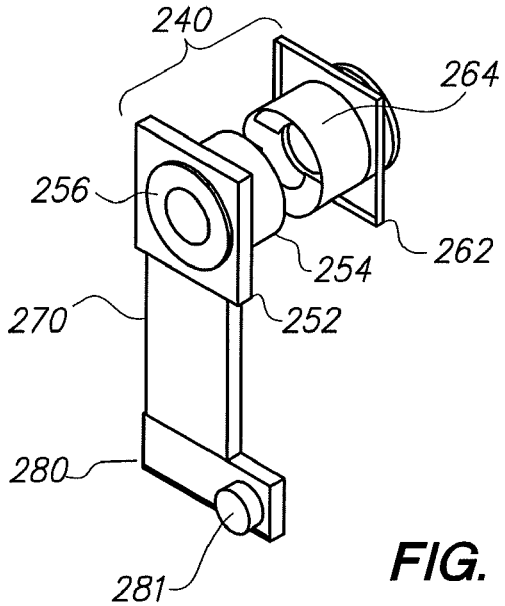
FIG. 8B is a perspective view of the system shown in FIG. 8A.
Figure 8C:
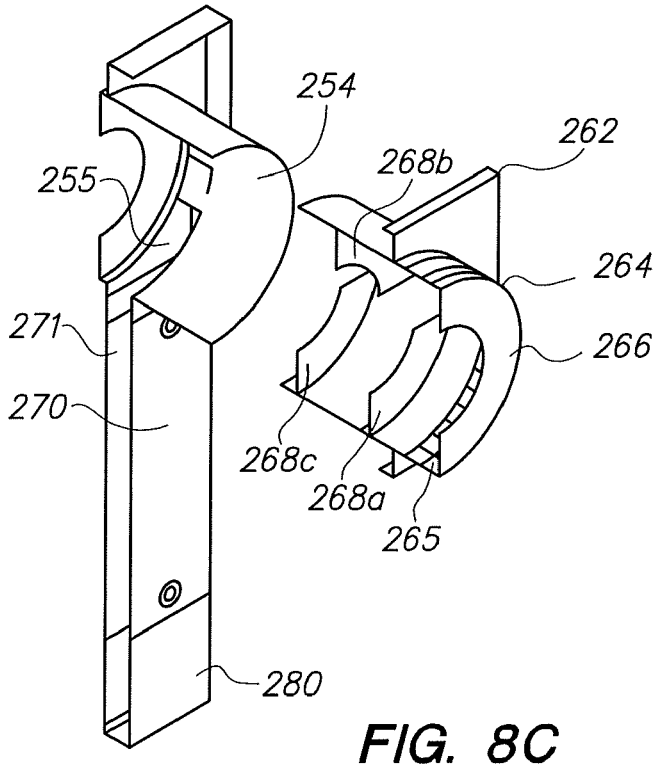
FIG. 8C is a perspective view taken across section C-C of FIG. 8B.
Figure 8D:
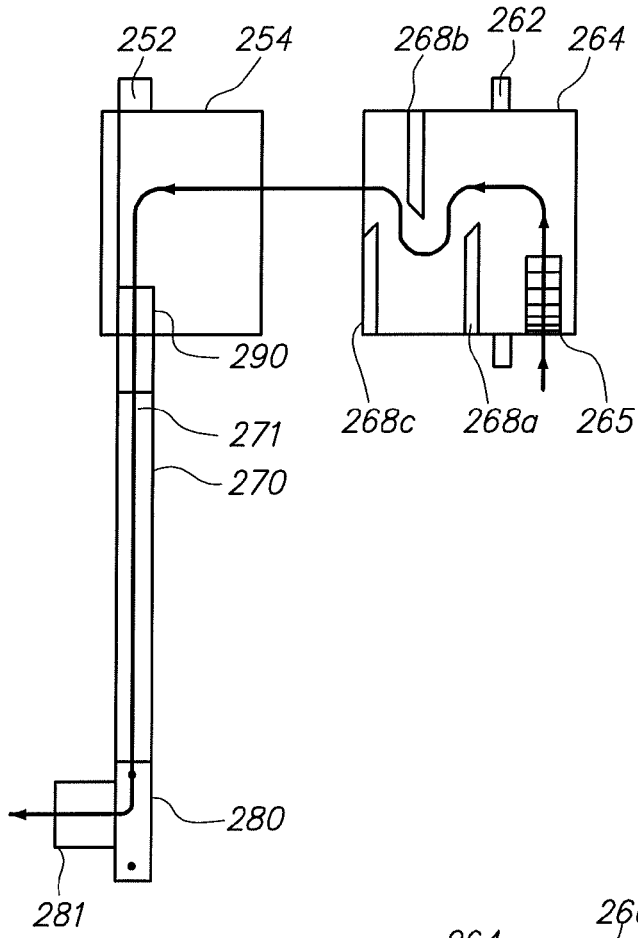
FIG. 8D is a side plan view taken of the system shown in FIG. 8A.

As shown in FIGS. 8B-8D, the wall thimble 240 is preferably formed as a two-part structure, namely the interior portion 254 and an exterior portion 264, each portion having a cover plate 256, 266, respectively. In a field installation, a wall opening is formed (not shown), and the interior mounting plate 252 is attached to the interior side of the wall opening, and the exterior mounting plate 262 is attached to the exterior side of the wall opening, for example, by nailing the mounting plates between wall studs. The mounting plates have central openings that must be coaxially aligned to receive the thimble parts. The interior portion 254 and exterior portion 264 are fitted together, then the interior portion is attached to the interior mounting plate 252, and the exterior portion 264 is attached to an exterior mounting plate 262, for example by welding or rivet.

The interior portion 254 and exterior portion 264 are both preferably formed as hollow cylindrical surfaces. The exterior portion 264 may be dimensioned slightly smaller in order to snugly insert into the interior portion 254 in mating correspondence. Alternatively, a recessed lip or other interlocking mechanism may be provided for mating the ends of the interior and exterior portions in well known manner. The heights of these cylindrical portions 254, 264 may be precut or field cut, but should be adequate to provide for some field adjustment to account for variations in wall thickness. Alternatively, a cylinder extension portion may be provided between the cylinder portions 254, 264, similar to portion go as shown in FIG. 3B.

The exterior cylinder portion 264 has an air intake vent 265 formed as a series of openings in the surface near the end of the cylinder. Note that the exterior cylinder portion 264 must be attached to the exterior mounting plate 262 such that the air intake vent 265 is positioned external to the structure so that outside air may be drawn in through the vent opening. The openings of the air intake vent 265 may extend around the entire circumference of the cylinder portion 264, but preferably, only a portion of the circumference will have the openings, namely, the downward facing surface.

The interior cylinder portion 254 also has an air intake vent 255 formed in the surface near the end of the cylinder, but on this end, the air intake vent is simply a radial section cut from the surface. Note that the interior cylinder portion 254 must be attached to the interior mounting plate 252 so that the interior air intake vent 255 is positioned inside of the mounting plate, in order to mate with a transition section 290.

Figure 9:
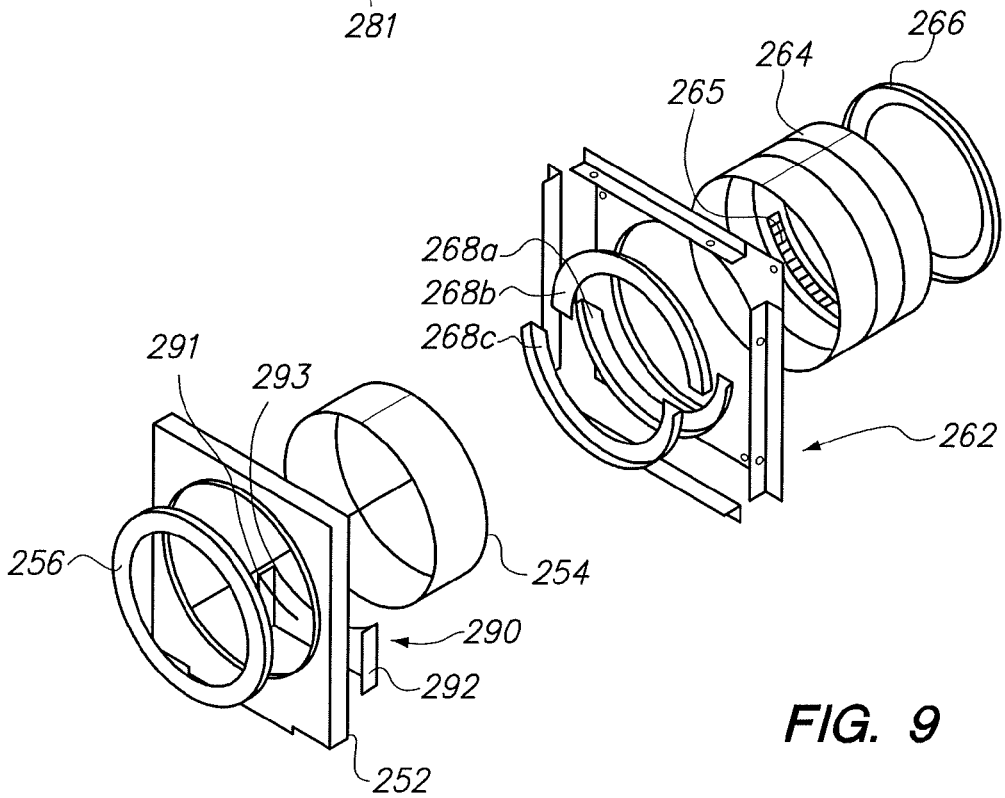
FIG. 9 is an exploded perspective view of the thimble shown in FIGS. 8A-8D.

FIG. 8C is a partial sectional view showing the interior construction of the exhaust/intake assembly 20*o*, and FIG. 9 is an exploded view of the thimble 240. These figures illustrate baffles 268*a*, 268*b*, 269*c*, which are affixed to the interior surface of the exterior portion 264, for example, by spot welding or rivets. Each of the baffles is half of a ring-shaped annulus, and the central opening of the annulus defined by the baffles has a diameter that is smaller than the diameter of the central openings 257, 267 defined by the cover plates. Typically, a gap of ⅛ inch defines the difference between the diameters of the baffles and the cover plate openings. The baffles are offset by being alternately affixed to the bottom and top surfaces of the cylinder portion 264, for example. Thus, the first baffle 268*a* is affixed to the bottom surface spaced apart from the intake vent 265, the second baffle 268*b* is affixed to the top surface, i.e., 180 degrees offset from the first baffle, at a position that is spaced apart from the first baffle, and the third baffle 268*c* is affixed to the bottom surface, i.e., 180 degrees offset from the second baffle at a position that is spaced apart from the second baffle.

Transition section 290 is shown best in FIG. 9, and is no more than a small piece of sheet metal 291 having side arms 292 which are attached to the backside of the interior mounting plate 252, for example, by weld or rivet, to create an enclosed throughway for the combustion air from the thimble to the vertical extension section (or directly to the exit section). The sheet metal panel 291 has a radial cut 293 formed in correspondence with the radial cut air intake vent 255 on the interior cylinder section 254, and upon installation, the air intake vent is aligned to communicate with the enclosed throughway of the transition section 290. Further, the vertical extension section 270, or the exit section 280, is then coupled to the transition section 290.

In operation, combustion air flow is provided to the heating appliance by taking in ambient outside air through air intake vent 265 in the exterior cylinder portion 264, which flows through the baffles 268*a*, 268*b*, 268*c* and around the exhaust pipe (not shown), then into the interior cylinder portion 254, down through the air intake vent 255 into transition piece 290, then into the interior 271 of vertical section 270, then into exit section 280, through the flexible pipe (not shown) which couples the outlet 281 to the combustion air inlet of the heating appliance.

Figure 10A:
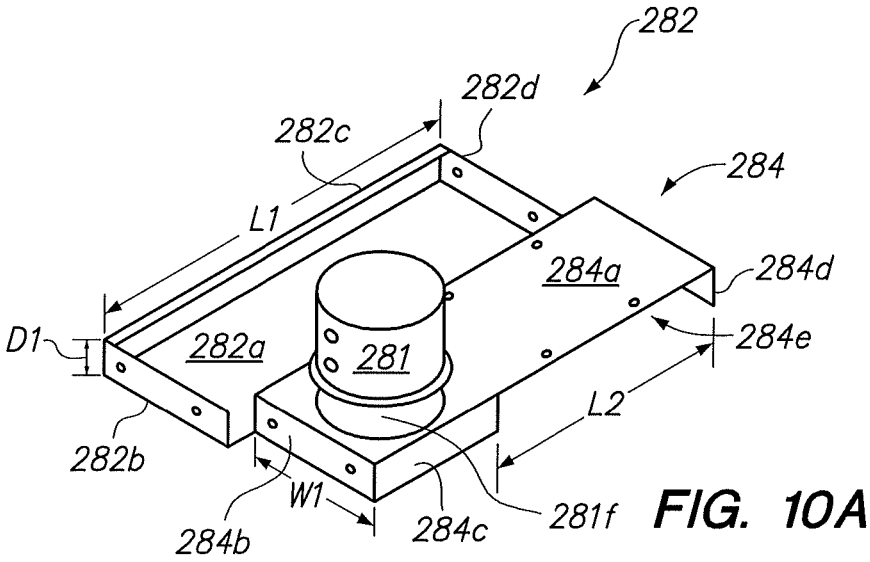
FIG. 10A is an exploded perspective view of the exit section shown in FIGS. 8A-8D.

Referring now to FIG. 10A, the exit section 280 is shown in more detail. The back section 282 is formed with a solid metal sheet 282*a* and three full sides 282*b*, 282*c*, 282*d*. The front section 284 is formed with a solid metal sheet 284*a* and two full sides 284*b*, 284*d*, a partial side 284*c* which defines an opening 284*e* on the same side, and an outlet opening 284*f*. An outlet coupling 281 is affixed into the outlet opening 284*f* Typical approximate dimensions for the exit section 280 include a width W1 of 4 inches, a total length L1 of 11 inches, a vent opening length L2 of 7 inches, and a depth D1 of 1 inch.

Figure 10B:
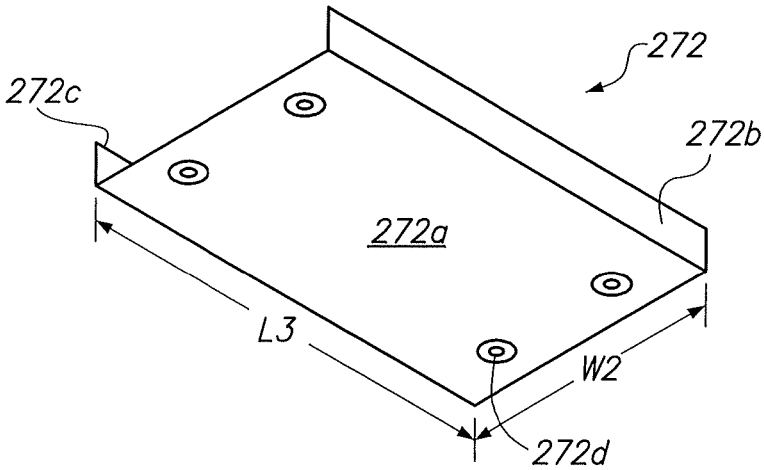
FIG. 10B is an exploded perspective view of the vertical section shown in FIGS. 8A-8D.
Figure 10B:
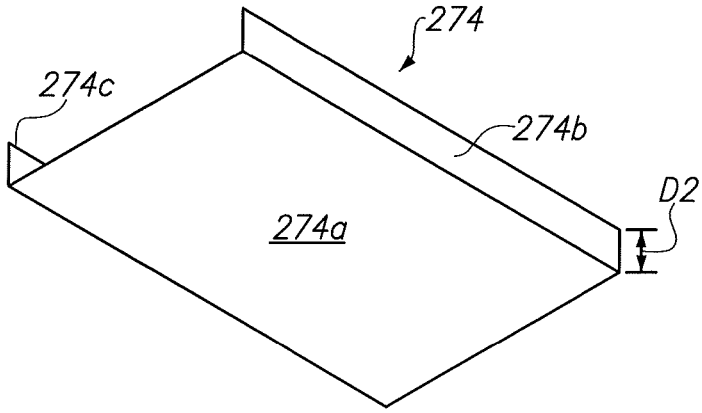
Figure 10C:
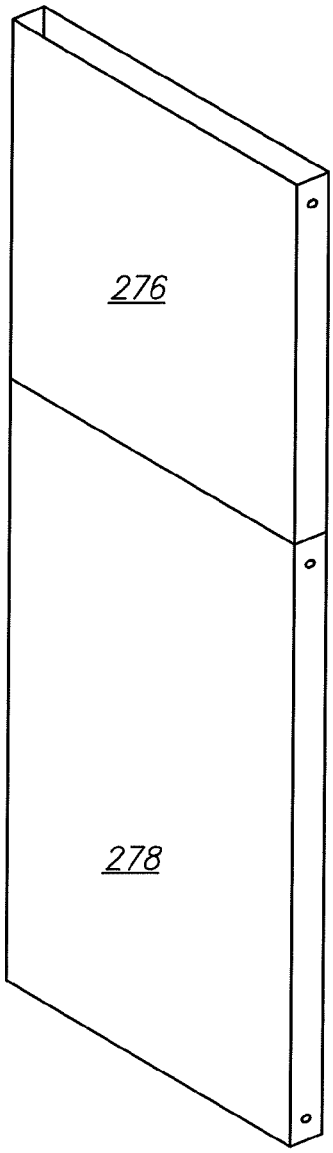
FIG. 10C is a perspective view of an alternative vertical telescoping section.
Figure 10D:
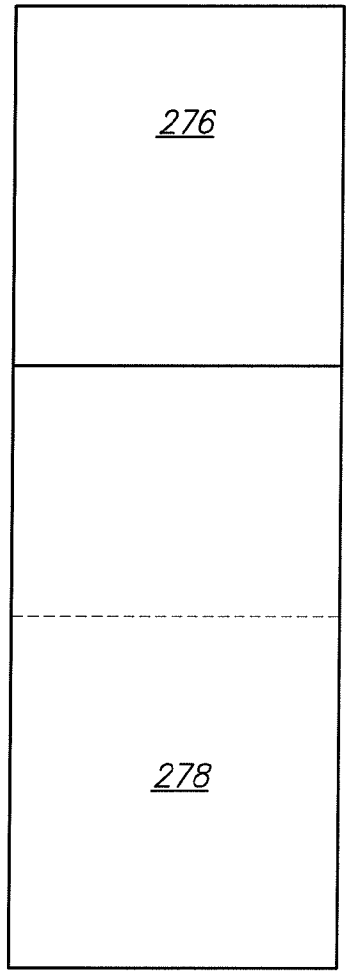
FIG. 10D is a front plan view of the alternative vertical telescoping section shown in FIG. 10C.

Referring to FIG. 10B, the back 272 of vertical section 270 is formed with a solid metal sheet 272*a* having two longs sides 272*b*, 272*c*, and mounting sites 272*d* for mounting the section to the interior wall, for example, with mechanical fasteners. The front 274 of vertical section 270 is formed with a solid metal sheet 274*a* having two longs sides 274*b*, 274*c*. Typical approximate dimensions for the vertical section 270 include a width W2 of 7 inches, a total length L3 of 12 inches, and a depth D2 (when installed) of 1 inch. However, the total length of the vertical section 270 may be varied depending upon the installation. For example, lengths up to 36 inches may be required for some installations. Further, in order to provide easy field adjustability, the vertical section 270 may be formed as a pair of telescoping panels 276, 278, as shown in FIGS. 10C and 10D. Panels 276 and 278 are formed as described above, except that panel 276 is slightly smaller than panel 278. Thus, panel 276 fits snugly within panel 278, and the panels are sized to provide significant vertical adjustment in a telescoping manner, as shown by the dashed lines in FIG. 10D. For example, the telescoping panels 276, 278 may provide a range of field adjustment from 1 to 36 inches. Since the intake air is under negative pressure, sealing the telescoping panels is not needed, but could be provided with RTV sealant, for example.

The foregoing detailed description has been presented for purposes of illustration and description. It is not intended to be exhaustive or limiting to the precise form disclosed. Many modifications and variations are possible in light of the above teachings. For example, common variations in dimensions, structures and materials exist, and suitable modifications to accommodate such different dimensions, structures and materials could readily be made. The described embodiments were chosen in order to best explain the principles of the disclosure and its practical application to thereby enable others skilled in the art to best utilize the disclosure in various embodiments and with various modifications as are suited to the particular use contemplated. It is intended that the scope of the invention be defined by the claims appended hereto.

We claim:

1. An interface for a wall opening as part of a heating appliance exhaust/intake system, wherein the heating appliance includes an exhaust outlet and a combustion air inlet, an exhaust pipe is coupled to the exhaust outlet, and an intake pipe is coupled to the combustion air inlet, comprising:

a structure having a rigid surface enclosing a volume of space, including an outside end with an outside opening and an inside end with an inside opening, wherein the outside opening and the inside opening are aligned with each other and sized to receive the exhaust pipe therethrough;

a first air intake vent formed through the rigid surface proximate to the outside end;

a second air intake vent formed through the rigid surface proximate to the inside end; and a baffle affixed to an inside portion of the rigid surface such that it extends into the volume of space;

wherein the structure is affixed to the wall opening such that the first air intake vent is positioned outside of the wall opening and the second air vent is positioned inside the wall opening, and wherein the intake pipe is coupled to communicate with the second air intake vent.

2. The interface of claim 1, further comprising:

a pair of mounting plates having corresponding mounting plate openings affixed on opposite sides of the wall opening, wherein the structure extends between the mounting plate openings and is affixed to each of the mounting plates.

3. The interface of claim 2, wherein one of the mounting plates is an interior mounting plate affixed to an interior portion of the wall opening, further comprising:

a combustion air duct communicating with the second air intake vent and the intake pipe.

4. The interface of claim 3, wherein the combustion air duct comprises:

a vertical section communicating with the second air intake vent; and an exit section coupled between the vertical section and the intake pipe.

5. The interface of claim 1, wherein the vertical section is formed in two parts, comprising a fixed portion and a telescoping portion integral with the fixed portion, the telescoping portion is adjustable for field installation.

6. The interface of claim 1, wherein the baffle includes a plurality of baffle portions disposed on the inside portion of the rigid surface, the baffle portions extending into the volume of space such that a gap is created when the exhaust pipe is routed through the structure.

7. A wall thimble system for mounting in a wall opening as part of exhaust/intake system for a heating appliance, wherein the heating appliance includes an exhaust outlet and a combustion air inlet, an exhaust pipe is coupled to the exhaust outlet, an intake pipe is coupled to the combustion air inlet, and a pair of mounting plates having corresponding mounting plate openings are affixed on opposite sides of the wall opening, comprising:

a first rigid surface enclosing a volume of space, the surface having opposing open ends that are sized in correspondence with the mounting plate openings, a first and second air intake vent each formed through the first rigid surface proximate to respective ends, and a baffle affixed to an inside portion of the first rigid surface such that it extends into the volume of space;

a pair of cover plates, each affixed to opposite ends of the first rigid surface, and each having a cover plate opening sized in correspondence with the exhaust pipe, the cover plate openings are smaller than the mounting plate openings; and a combustion air duct comprising a second rigid surface enclosing a volume of space and having a first opening on one end coupled to the second air intake vent and a second opening on another end;

whereupon installation, the first rigid surface is affixed to the mounting plates such that one end thereof extends through one mounting plate opening with the first air intake vent located outside the one mounting plate and the other end thereof terminates at the other mounting plate opening with the second air intake vent located inside the other mounting plate, the exhaust pipe is routed through the cover plate openings, and the intake pipe is coupled to the second opening of the combustion air duct.

8. The wall thimble system of claim 7, wherein the first rigid surface is formed in two parts that mate with each other.

9. The wall thimble system of claim 8, wherein the first rigid surface comprises:

a first part having an interior end and an exterior end, wherein the first air vent is formed proximate to the exterior end, and the baffle is formed spaced apart from the exterior end; and a second part having an interior end and an exterior end, wherein the second air vent is formed proximate to the exterior end, and wherein the interior end mates with the interior end of the first part.

10. The wall thimble system of claim 9, wherein the first part and second part are formed as hollow cylinder portions.

11. The wall thimble system of claim 7, wherein the combustion air duct comprises a vertical extension portion coupled at one end to the second air vent opening and at another end to an exit portion, and wherein the exit portion includes an outlet to which the intake pipe is coupled.

12. The wall thimble system of claim 11, wherein the vertical extension portion includes a fixed portion and a telescoping portion integral with the fixed portion, the telescoping portion is adjustable for field installation.

13. The wall thimble system of claim 7, wherein the baffle includes a plurality of baffle portions disposed on the inside portion of the rigid surface, the baffle portions extending into the volume of space such that a gap is created when the exhaust pipe is routed through the structure.

14. An exhaust/intake system used with a heating appliance, wherein the heating appliance includes an exhaust outlet and a combustion air inlet, an exhaust pipe is coupled to the exhaust outlet, and an intake pipe is coupled to the combustion air inlet, comprising:

a first mounting plate and a second mounting plate, wherein each mounting plate includes a mounting plate opening of a first diameter;

a cylindrical structure affixed to the mounting plates in correspondence with the mounting plate openings, comprising a hollow cylinder having the first diameter, a pair of cover plates affixed to opposing ends of the cylinder, wherein each cover plate includes a cover plate opening having a second diameter which is smaller than the first diameter, a pair of air intake vents each formed through the cylinder proximate to respective ends, a baffle affixed to an inside portion of the hollow cylinder and extending radially into the volume of space; and a combustion air duct having a top opening and a bottom opening;

whereupon installation, the mounting plates are affixed to opposite sides of a wall opening, the cylindrical structure is affixed to the mounting plates such that the first air vent is disposed inside the first mounting plate and the second air vent is disposed outside the second mounting plate, the exhaust pipe is routed through the cover plate openings, the vent portion is coupled to the first mounting plate such that the top opening is proximate to the first air vent, and the intake pipe is coupled to the bottom opening of the combustion air duct.

15. The exhaust/intake system of claim 14, wherein the hollow cylinder is formed in two cylinder parts that mate with each other.

16. The exhaust/intake system of claim 14, wherein the combustion air duct comprises a vertical extension portion coupled to an exit portion, wherein the intake pipe is coupled to the exit portion.

17. The exhaust/intake system of claim 16, wherein the vertical extension portion is adjustable.

18. The exhaust/intake system of claim 16, wherein the vertical extension portion includes a fixed portion and a telescoping portion integral with the fixed portion, the telescoping portion is adjustable for field installation.

19. The exhaust/intake system of claim 14, wherein the baffle includes a plurality of baffle portions disposed on the inside portion of the hollow cylinder, the baffle portions extending into the volume of space such that a gap is created when the exhaust pipe is routed through the structure.

20. The exhaust/intake system of claim 19, wherein each of the baffle portions comprises half of a ring-shaped annulus, each annulus being spaced apart from the others, and each successive annulus disposed on opposite sides of the inside portion of the hollow cylinder.

* * * * *